US005327831A

United States Patent [19]

Depa et al.

[11] Patent Number: 5,327,831

[45] Date of Patent: Jul. 12, 1994

[54] PRINTING PRESS BLANKET CYLINDER ASSEMBLY, MOUNTING AND DISMOUNTING SUBASSEMBLIES AND METHOD OF USING SAME

[75] Inventors: Louis S. Depa, Downers Grove; Robert L. Fisher, Chicago, both of Ill.

[73] Assignee: Rockwell International Corporation, El Segundo, Calif.

[21] Appl. No.: 915,151

[22] Filed: Oct. 1, 1992

Related U.S. Application Data

[62] Division of Ser. No. 722,039, Jun. 27, 1991, Pat. No. 5,188,031.

[51] Int. Cl.[5] ..... B41F 1/28

[52] U.S. Cl. ..... 101/401.1; 101/479; 101/415.1

[58] Field of Search ..... 101/415.1, 479, 378, 101/389.1, 382.1, 376, 379, 401.1

[56] References Cited

U.S. PATENT DOCUMENTS

| | | | |
|---|---|---|---|
| 4,036,133 | 7/1977 | Kocsis et al. | 101/415.1 |
| 4,122,774 | 10/1978 | Sauer | 101/415.1 |
| 4,154,167 | 5/1979 | Czinger | 101/415.1 |
| 4,742,772 | 5/1988 | Grose | 101/415.1 |
| 4,862,800 | 9/1989 | Wieland | 101/415.1 |
| 4,938,135 | 7/1990 | Wieland | 101/415.1 |
| 5,005,477 | 4/1991 | Schroeder | 101/415.1 |
| 5,076,166 | 12/1991 | Herold et al. | 101/415.1 |
| 5,117,755 | 6/1992 | Fina | 101/415.1 |
| 5,188,031 | 2/1993 | Depa et al. | 101/415.1 |
| 5,189,958 | 3/1993 | Tafel et al. | 101/415.1 |

*Primary Examiner*—Eugene H. Eickholt
*Attorney, Agent, or Firm*—C. B. Patti; H. F. Hamann

[57] ABSTRACT

A printing blanket cylinder assembly (14',16') with an exposed edge (60) at the end of an inwardly turned mounting member (30M, 34M) protectively enclosed within a mounting slot (32) within a blanket cylinder (16) while an outer layer (40) of the blanket (34) is protectively wrapped around a leading edge (30D) of a metal backing plate (30) to both protect intermediate layers (44, 48) of the blanket (34) and the bonds therebetween from the deleterious effects of dampening liquid while concurrently providing a gap (56) of preselected size to achieve a stress-free boundary for the blanket (34) on opposite sides of the gap (56) for optimal vibration reduction. An ejector mechanism (70) is mounted to the cylinder (16) for pushing the mounting member (30M, 34M) out of the slot (32) during removal of the blanket (34) from around the cylinder (16). The ejector mechanism (70) includes a rotatable adjustment member (74) located outside of the mounting slot (32) and linked with an ejector blade (62) for causing it to move within the mounting slot (32).

5 Claims, 2 Drawing Sheets

PRINTING PRESS BLANKET CYLINDER ASSEMBLY, MOUNTING AND DISMOUNTING SUBASSEMBLIES AND METHOD OF USING SAME

This is a division of application Ser. No. 722,039, filed Jun. 27, 1991 now U.S. Pat. No. 5,188,031 issued Feb. 23, 1993.

BACKGROUND OF THE INVENTION

1. Field of the Invention

This invention generally relates to a printing press and methods of using same and, more particularly, to a printing press blanket cylinder assembly, subassemblies and method of using same.

Description of the Related Art Including Information Disclosed Under 35 CFR 1.97-1.99

The performance boundaries of web-fed rotary printing presses have traditionally been limited by the phenomenon of "streaking" in the form of partial or complete ink discontinuities which extend along one or more lines parallel to one another and transverse to the direction of travel of paper. It is known that this phenomenon is the result of transient vibrations of the printing cylinders induced by the repetitive passage of surface discontinuities through the line of contact between coacting cylinders. Such discontinuities are present in lithographic process printing presses as a consequence of the need for removable, image-carrying plates and for removable, resilient blankets used for image offsetting to the paper or for impression support behind the paper when printing is done directly from the plate. Various mechanisms are known which secure the ends of plates and blankets to the cylinders that require some space for insertion and removal of the ends which disallows a continuous surface around the cylinder circumference.

In contrast, rotogravure presses operate with the image engraved directly into the cylinder surface. This permits a continuous surface, and thus rotogravure presses do not exhibit the streaking phenomenon. Unfortunately, when the image has to be changed, the entire cylinder must be removed from the presses.

A typical printing press of the general type to which this invention relates will exhibit an increasing tendency to produce streaked printing as the rate of cylinder rotation, or press speed, increases. Thus some maximum operating speed is established at which streaking is not observable or not intense enough to cause rejection of the printed product. Observation of the behavior of such a press has lead others to the conclude that streaking is a monotonic function of press speed. Based on this conclusion, certain actions have been taken by others to provide a greater range of acceptable press performance as it is judged in regard to streaking.

Attempts have been made to reduce the severity of the disturbance created by the passage of the cylinder discontinuity. Kirkus teaches in U.S. Pat. No. 3,395,638 issued Aug. 6, 1968, that this can be accomplished by gradually reducing the cylinder radius as the discontinuity is circumferentially approached from either direction. This has the effect of reducing the time dependent force derivatives that contribute to the imposed disturbance. An expedient method used to emulate this effect is to "feather" the sheets of paper that are placed between the blanket cylinder body and the blanket to obtain the correct overall dimension for printing. Feathering is the process of placing several such sheets of paper on the cylinder which are cut to different lengths so the effective radius of the blanket cylinder is reduced in the vicinity of the discontinuity location. Bartlett teaches in U.S. Pat. No. 4,466,349 issued Aug. 21, 1984, that locating the line of discontinuity at an angle skewed relative to the axis of cylinder rotation will reduce the disturbing effect by allowing the discontinuity to pass through the line of contact progressively from one end of the cylinder to the other instead of along the entire cylinder at one time.

These two approaches to disturbance magnitude reduction have not found widespread use for two reasons. One is that the attempt to reduce the pressure gradient in the vicinity of the discontinuity also necessarily reduces the pressure available to affect ink transfer and therefore places a limit on the cylinder circumference which can actually be used for printing. The second reason is that manufacturing variable radius cylinders and skewed discontinuities is more complicated and thus more costly than manufacturing conventional cylinders. The feathered packing approach adds complexity to press operation and thus increases the variable cost of print production.

Attempts have been made to counter the streaking effect by providing a damping mechanism to more rapidly dissipate the energy imparted to the cylinders by the discontinuity. In U.S. Pat. No .4,125,073 issued Nov. 14, 1978 to the present inventor, an impact damper is incorporated into a cylinder to create a process of momentum transfer which prevents persistent transient oscillation of the cylinder following a disturbance. While such a damper has great advantage, it is difficult to manufacture because of the precise tolerances required for optimal performance and is also subject to wear which reduces its effectiveness over time.

The failure of these attempts to provide a completely satisfactory solution to the streaking problem has led some in the industry to believe that the problem must be solved by eliminating the discontinuity in the cylinder surfaces. This way of thinking implies that any discontinuity, however small, will ultimately produce the streaking phenomenon if the press is run at a high enough speed. Kirkpatrick and Warll in U.S. Pat. No. 3,765,329 issued Oct. 16, 1973; Matuschke in U.S. Pat. No. 4,403,549 issued Sep. 13, 1983; Banike in U.S. Pat. No. 4,577,560 issued Mar. 25, 1986 and Zeller in U.S. Pat. No. 4,742,769 issued May 10, 1988 teach methods for complete elimination of discontinuities. However, in applying these methods extreme precision in the gross dimensions of the removable plates and blankets is required if the intention is to make the ends of these elements meet in full contact over the length of the cylinders, but such precision is inconsistent with the normal operating environment of a printing facility. Alternatively, providing means for sealing a residual gap when the ends of the elements cannot be made to meet perfectly complicates the installation and removal processes and thus increases the time and cost associated with preparing a press for operation.

Other blanket mounting mechanisms have been used to reduce vibration, but these also suffer from other disadvantages. In U.S. Pat. No. 4,648,318 of Fisher issued Mar. 10, 1987, the reinforced ends of a blanket cylinder are inserted into a groove with narrowed ends to reduce the effective width of the groove to reduce vibration. In U.S. Pat. No. 4,829,896 of Norkus issued May 16, 1989, a printing blanket is mounted to a cylinder by means of a pair of lock-up mechanisms with slots within which the reinforced ends of the blanket are respectively received and then twisted to tighten down the blanket against the cylinder to reduce vibration, but this disadvantageously distorts and stresses the blanket. A similar twisting lockup is shown in U.S. Pat. No. 4,217,825 of Bruckner issued Aug. 19, 1980, which also causes blanket distortions during tightening. A relatively "gapless blanket" to reduce vibration is achieved in U.S. Pat. No. 4,817,527 of Wouch et al. issued Apr. 4, 1989, by means of a magnetic cylinder.

In copending U.S. patent application Ser. No. 07/452,914 of Lawrence J. Bain entitled "Printing Press Blanket Cylinder Assembly and Method of Making Same" and assigned to Rockwell International Corporation, now U.S. Pat. No. 5,038,680 issued May 13, 1991, a blanket cylinder assembly is shown in which a gap of preselected size between the opposite ends of the blanket is provided to provide a stress-free boundary condition at opposite ends to reduce vibrations. While this approach achieves its objectives and overcomes many of the disadvantages of the prior art noted above, unfortunately it also results in leaving the leading edge exposed to deleterious pressure contact with dampening liquid. Such contact with the dampening liquid causes the formation of bolsters due to absorption, deterioration to the bonds between interior plys of the blanket and resultant reduction in the useful life of the blanket assembly. In addition, in the preferred embodiment of the blanket cylinder assembly of Bain, both edges of the blanket require expensive magnets to hold the blanket to the body of the blanket cylinder.

SUMMARY OF THE INVENTION

It is therefore a principal object of the present invention to provide a printing press blanket cylinder assembly, subassemblies and method of using same which maintains the advantages of the aforementioned printing press blanket cylinder assembly of U.S. Patent Application of Bain over the prior art while overcoming the problem caused by contact of the dampening liquid with the exposed leading edge of the blanket and providing a mounting means to reduce the number or strength of expensive magnets needed to hold the blanket assembly to the blanket cylinder without distorting the blanket.

This object is achieved by provision of a printing blanket having a multiply body with at least one inner ply having an exposed edge susceptible to deterioration from contact with dampening liquid, an outer ply substantially impervious to dampening liquid and means including the substantially impervious outer ply for protecting the exposed edge from deleterious contact with dampening liquid on the cylindrical body.

The objective is also achieved by provision of a printing blanket assembly with a resilient backing plate having a body preformed into the shape of a split cylinder, with a pair of adjacent, opposed, parallel edges and a mounting member extending inwardly from one of the pair of edges toward the interior of the cylinder for receipt within a mating mounting slot of a blanket cylinder, a resilient printing blanket coextensively covering substantially the entire rectangular body including at least part of the inwardly extending mounting member, and means for securing the resilient blanket to substantially the entire resilient backing plate including at least part of the inwardly extending mounting member to hold the blanket snugly against the backing plate in the same cylindrical shape as the split cylinder shape with the inwardly extending mounting member.

The objective of the invention is also obtained by provision of a printing blanket cylinder having a cylindrical body with a slot for receipt of a mounting member of a printing blanket assembly and an ejector mechanism mounted to the cylindrical body for pushing the mounting tip out of the slot during removal of the printing blanket assembly from around the cylindrical body.

Further, the object is achieved by providing a method of dismounting a blanket assembly with a mounting member and a substantially cylindrical body from a blanket cylinder with a mounting slot comprising the steps of at least partly removing a mounting member from within the mounting slot at least in part by pushing the mounting member from within the slot and removing the remainder of the blanket assembly from around the blanket cylinder after the mounting member has been at least partly removed from the mounting slot.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENTS

Figure 1:
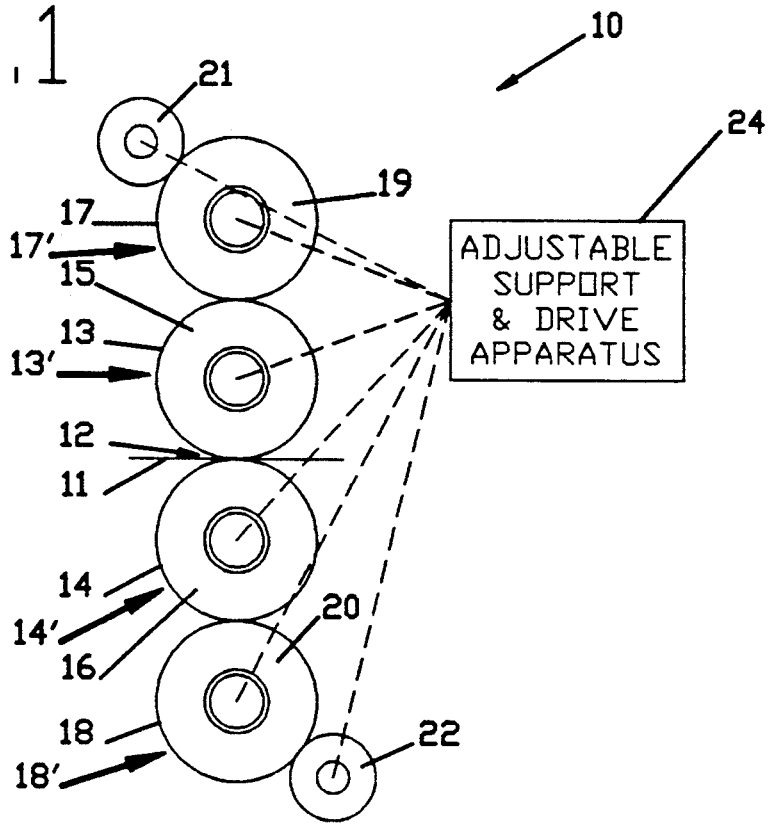
FIG. 1 is a schematic side elevation of a printing press incorporating the preferred embodiment of the blanket cylinder assembly of the present invention and its blanket cylinder.

Referring to FIG. 1, an offset printing press 10 has a nip region 12 within which printing contact is effected between opposite sides of a paper web, or paper, 11 and a pair of substantially identical printing blanket cylinder assemblies 13' and 14' of the present invention. Printing blanket cylinder assemblies 13' and 14' comprise blanket assemblies 13 and 14, respectively, which are wrapped around blanket cylinder assemblies, or blanket cylinders, 15 and 16, respectively. Ink impressions on the blanket assemblies 13 and 14 are thereby transferred to the opposite sides of the paper 11 in the nip region 12 at an engagement plane intersecting the axes of the blanket cylinders 15 and 16.

Ink is applied to the blankets 13 and 14 from inked printing plate cylinder assemblies 17' and 18'. Plate cylinder assemblies 17' and 18' comprise printing plates and 17 and 18, respectively, which are wrapped around plate cylinders 19 and 20, respectively. Plate cylinders 19 and 20 are mounted for rotation about axes in coplanar and spaced parallel relation to the axes of blanket cylinders 15 and 16. The lines of contact between blanket assemblies 13 and 14 and plates 17 and 18 are thereby in the aforementioned engagement plane intersecting the cylindrical axes and are preferably, although not necessarily, diametrically opposite the nip region 12 through which the paper 11 passes. Ink and dampening mediums are applied to the printing plates 17 and 18 from rollers, such as rollers 21 and 22.

Axial shafts of the blanket cylinders 15 and 16 and the plate cylinders 19 and 20 are supported and driven by an adjustable support and drive apparatus 24. The apparatus 24 is adjustable to control the distance between the axes of the blanket cylinders 15 and 16 and also the distances between the axes of the blanket cylinders 15 and 16 and those of the plate cylinders 19 and 20. The pressure applied from the blankets 13 and 14 to the paper 11 and the pressures applied from the plates 17 and 18 to the blankets 13 and 14 is controlled by controlling the distances between the axes.

The blanket assemblies 13 and 14 are compressed to effect transfer of ink therefrom to the opposite sides of the paper 11 and to effect transfer from the plates 17 and 18 to the blanket assemblies 13 and 14. Such resilient compression is achieved by positioning the axes of the blanket cylinders 15 and 16 at a distance from each other which is less than the sum of the diameter and the thickness of the blanket and by similar positioning of the axes of the plate cylinders 19 and 20 relative to the axes of the blanket cylinders 15 and 16.

It is also necessary that each of the plates 17 and 18 and blanket assemblies 13 and 14 be mounted securely to their respective cylinders with opposite ends securely attached thereto during operation by means which facilitates their easy removal as needed. In addition, as explained below with reference to FIG. 2, mounting of the blanket to its cylinder is accomplished by means which avoids the extreme pressure variations that have caused oscillations of the cylinders and streaking, especially at high production speeds, in prior art devices while reducing the need for magnets and protecting the interior of the blanket assemblies 14 and 15 from deleterious effects of contact with the dampening liquid.

Figure 2:
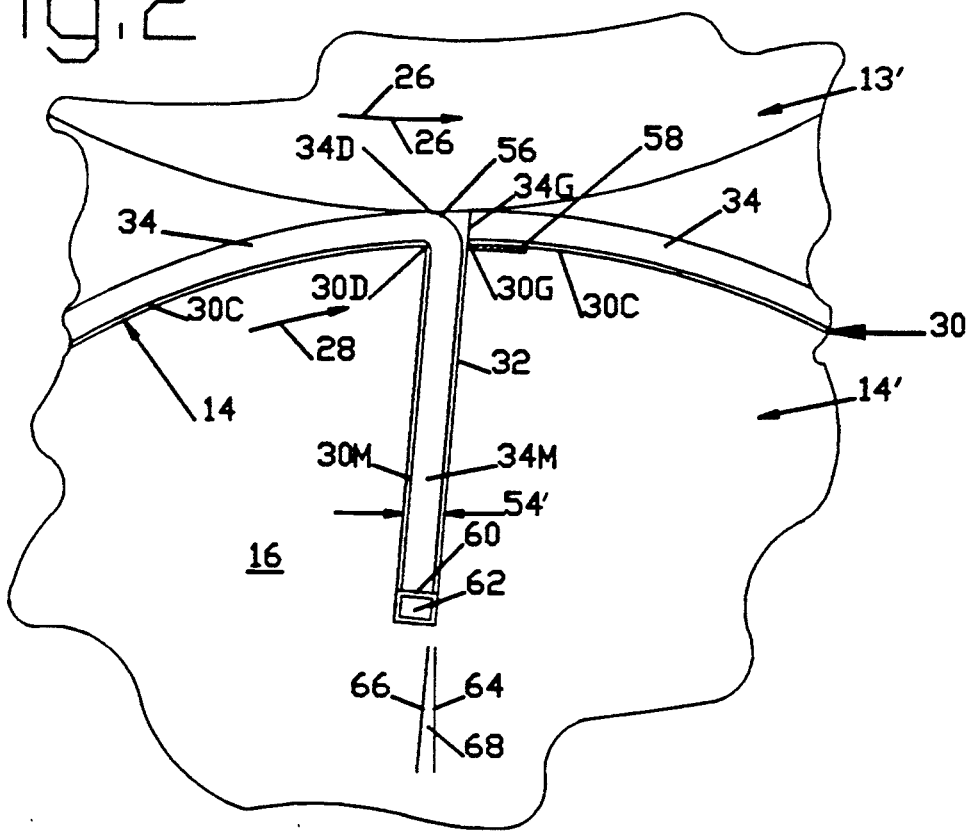
FIG. 2 is a schematic, cross sectional view of the blanket assembly and cylinder of the present invention.

Referring now to FIG. 2, a schematic end view illustration of the preferred embodiment of blanket assembly 14 as mounted on the blanket cylinder 16 of FIG. 1 adjacent the nib 12 is shown in greater detail. For purposes of simplicity the details of the printing blanket cylinder assembly 13' are neither shown or described with the understanding that the printing blanket cylinder assembly 13' is substantially identical to the printing blanket cylinder assembly 14' as shown in detail in FIG. 2 and described below. In addition, for reference it should be understood that the printing blanket cylinder assemblies 13' and 14' rotate in the direction indicated by arrows 26 and 28, respectively.

The blanket assembly 14 has a backing plate 30 made from a rectangular piece of metal, preferably ferromagnetic stainless steel, which is formed into a split cylinder with a cylindrical body 30C and a pair of adjacent, opposed parallel edges, leading edge 30D and lagging edge 30G, and a lip, or mounting member, 30M. The mounting member 30M extends inwardly from the leading edge 30D toward the interior of the cylinder of the cylindrical body 30C for receipt within a mating mounting slot 32 of the blanket cylinder 16. Preferably, the mounting member 30M is also made of steel integrally formed with, and inwardly turned from, the cylindrical body 30C. Although somewhat resilient, the backing plate is of sufficient thickness, on the order of fourteen mils, that it will maintain its configuration and provide structural strength and integrity for the remainder of the blanket assembly 30.

Figure 3:
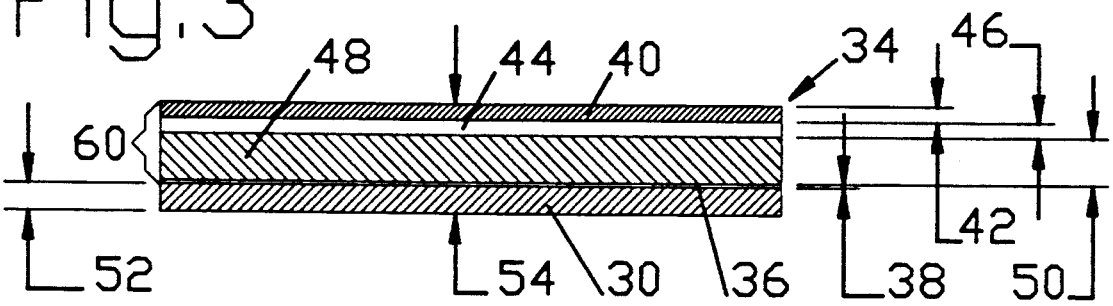
FIG. 3 is a cross sectional side view of a section of the printing blanket assembly of FIG. 2.

The remainder of the blanket assembly 14 comprises a resilient and flexible printing blanket 34 coextensively covering substantially the entire backing plate 30 including a mounting portion 34M covering at least part, if not all, of the mounting member 30M as well as all of the cylindrical body 30C. The resilient blanket is too flexible to maintain its own shape, and the structural strength provided by the backing plate 30 enables mounting of the blanket assembly 14 by sliding it over the end of the cylinder 16. The blanket 34 is secured to substantially the entire backing plate 30 including the mounting part 34M covering at least part of the inwardly extending mounting member 30M. The blanket 34 is snugly held against the backing plate 30 in the same cylindrical shape as the shape of the split cylindrical body 30C with the inwardly extending mounting member 30M. Referring to FIG. 3, the means for securing the blanket 34 to the backing plate 30 preferably comprises a coextensive layer 36 of thermal activated, or hot melt, epoxy cement having a thickness 38 of approximately three mils.

Still referring to FIG. 3, the blanket 34 is multiply, having three layers, or plys. An outer layer 40 of rubber-like material has a thickness 42 of approximately eight mils and is relatively impervious to dampening liquid and ink which are applied to its outer surface. An intermediate layer 44 is formed of a suitable fabric having a thickness 46 of approximately ten mils. The innermost layer 48 is made of a compressible material, such as foam-rubber like material and is the layer which is cemented to the backing plate 30 by epoxy layer 36. This bond is also susceptible to deterioration by contact with dampening liquid. The intermediate compressible layer 48 has a thickness 50 of approximately twenty-four mils while the stainless steel backing plate 30 has a thickness 52 of approximately fourteen mils plus or minus one mil. This gives a total thickness 54 for the entire blanket assembly 30 of approximately fifty-one mils. The intermediate layer 44 is bonded to the outer layer 40 and inner layer 48 by fusion, cement or other suitable means. These bonds are also susceptible to damage from dampening liquid.

During assembly, the blanket 30 is wrapped and stretched around the leading edge 30D and cemented thereto and to the cylindrical body 30C and the mating member 30M by the epoxy layer 36 to maintain a uniform thickness of the portion of blanket 34 overlying the cylindrical body 30C adjacent the leading edge 30D. Adjacent the mounting member 30M, on the other hand, the blanket is pressure formed to reduce the overall maximum thickness 54' FIG. 2 relative to the overall thickness 54, FIG. 3, adjacent the cylindrical body 30C. This reduction advantageously reduces the minimum cross sectional size of the mating slot 32 within the cylinder 16 to reduce the gap 56 between the lagging edge 34G of the outermost surface of the blanket 34 and the lagging edge 34G of the outermost surface of the blanket 34 opposite the leading edge 30D of the backing plate 30 to a preselected size for optimal vibration reduction.

The pressure forming of the blanket assembly 14 also ensures that the maximum thickness 54' of the mounting member 30M is less than the thickness of the mounting slot 32 by approximately only one mil to provide a snug fit when the mounting member 30M together with the attached mounting portion 34M of the blanket 34 are received with the slot 32. This snug fit is important to ensure sufficient friction and binding engagement between the mounting member 30M and blanket mounting portion 34M and the interior of the slot 32 to tightly hold the cylindrical body of the blanket assembly 14 against the side of the blanket cylinder. If the hold is sufficient, the need for a magnet adjacent the leading edge 30D such as magnet 58 opposite the lagging edge 30G which holds it to the surface of the cylinder 16 can be eliminated. Advantageously, the snug fit also reduces the amount of dampening liquid collected in the gap 56 which will seep inwardly into the slot 32 and into contact with the exposed edge 60, FIG. 2, at the end of the mounting portion 34M which appears in detail in FIG. 3.

It has been discovered that dampening liquid has deleterious effects on blanket 34 if the intermediate layer 44 and the outer layer 48 are exposed to dampening liquid, bonds therebetween and the epoxy layer 36. In such event, the dampening liquid is absorbed within the fabric layer 40, the compressible layer 48 and between these layers and the inner layer 48 and the backing plate 30. This causes the outer rubber-like layer 40, which is impervious to the dampening liquid, itself, to expand outwardly and form bolsters or pressure ridges on the outermost printing surface of the blanket 34. These bolsters interfere with optimum operation and, if severe, can significantly reduce the useful life of the blanket assembly 14.

In accordance with the present invention, this problem has been overcome in several different respects, and the bolster forming characteristic has been used to advantage. First, as seen in FIG. 2, because the outer rubber-like layer 40, FIG. 3, is wrapped around the leading edge 30D, it protects the inner layers 44 and 48 at the leading edge 30D and the bonds therebetween from contact with the dampening liquid. The lagging edge 30G of the backing plate 30 substantially abuts against the outer impervious layer 40 of the blanket 34 when it is inwardly turned around the leading edge 30D. The exposed edge 60 of the blanket 34 which is located at the leading edge of a gap at the outer surface of the blanket cylinder assembly of the aforementioned patent application of Bain has been moved to a location spaced inwardly from gap 56 and away from the outer surface at the end of the inwardly turned portion 34M. It is also protectively encased within the mounting slot 32, and should bolsters form from contact of dampening liquid with the exposed blanket edge 60, such contact now only causes the mounting member 30M and 34M to fit more tightly within the mounting slot 32 to achieve a more secure blanket mounting. More importantly, because the exposed edge 60 is substantially spaced from the cylindrical printing surface of the blanket 34, any dampening liquid absorbed at edge 60 will not form bolsters at the printing surface which would interface with printing and reduce the useful life of the blanket assembly 14.

In keeping with one aspect of the invention, both the cylindrical mounting member 30M and mounting portion 34M, and the slot 32 extend inwardly toward the interior of their concentric cylinders in a direction 66 backward away from a radial direction 64 and away from leading edges 30D and 34D. An acute angle 68 is formed between the nonradial direction 66 and the radial direction 66. It has been empirically determined that if angle 68 is too small, the mounting members 30M and 34M have a tendency to pull out of the mounting slit 32. If the angle 68 is too large, a gap 56 is required which is larger than necessary to achieve the desired stress-free boundary for optimal vibration reduction. Preferably the angle 68 by which the nonradial direction 66 is off of the radial direction 68 is approximately ten degrees which has been found to obtain optimal results.

Should the fit be so tight that the mounting member 30M and the mounting portion 34M of the blanket cannot be easily removed, an ejector blade 62 at the bottom of the slot 32 is used to push the mounting member 30M and mounting portion 34M outwardly from within the slot 32. After the ejector blade 62 has elevated the mounting plate sufficiently off the surface of the cylinder 16 to enable grasping the blanket assembly 14, the mounting member 30M and mounting portion 34M are manually pulled entirely out of the slot 32 and the blanket assembly 14 removed. As previously noted, during mounting, the blanket assembly 14 is advantageously slid into mounting engagement with the cylinder 16 from the end of the cylinder 16.

Figure 4:
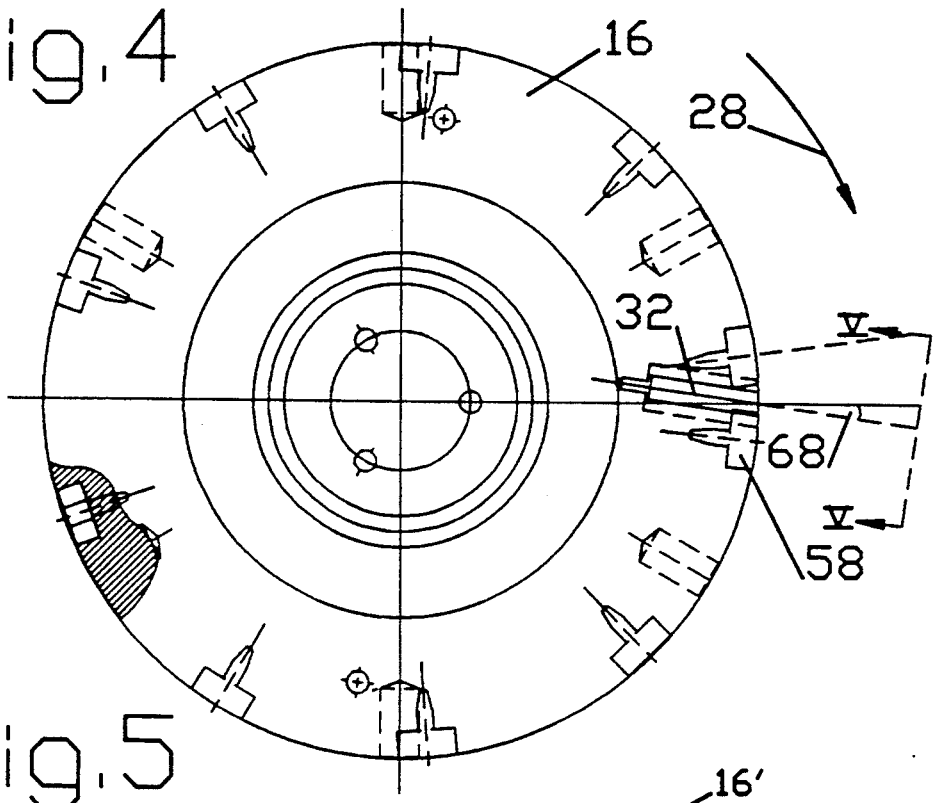
FIG. 4 is an end view of a commercial embodiment of the blanket cylinder illustrated schematically in FIG. 2.
Figure 5:
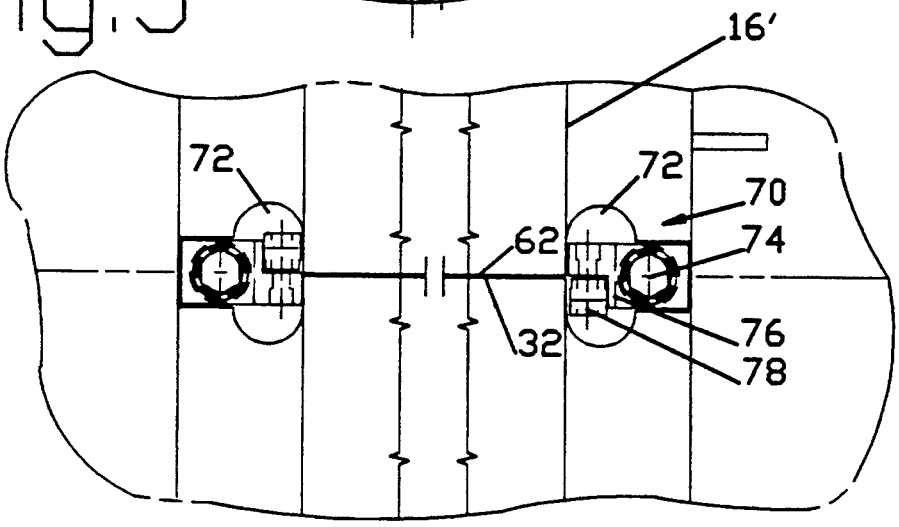
FIG. 5 is an enlarged view of a portion of the blanket cylinder taken from view line V—V of FIG. 4 and showing the ejector blade assembly of the present invention schematically illustrated in FIG. 2.

Referring to FIG. 5, which is a view of a portion of a commercial embodiment of the cylinder 16 opposite the mounting slot 32 of FIG. 4, an ejector mechanism 70 of which the ejector blade 62 is a part is illustrated. The mounting slot 32 opens into identical access cavities 72 at opposite ends 16 of the cylinder. Located within the access cavities are adjustment bolts 74 rotatably mounted to blade plates 76. The opposite ends of the ejector blade 62 are mounted to the blade plates 76 by fasteners 78. The adjustment bolts 74 are threaded into a tapped hole in the cylinder which are aligned with the slot 32, and when the adjustment bolt is turned counterclockwise, the bolt 74, plate 76 and the elongate ejector blade 32 driven outwardly against the exposed end 60 of the mounting members 30M and 34M. When turned in a clockwise direction, the adjustment bolt 74 and plate 76 cause the ejector blade to move inwardly toward the bottom of the slot 32.

While a detailed description of the preferred embodiment of the invention has been given, it should be appreciated that many variations can be made thereto without departing from the scope of the invention as set forth in the appended claims. For instance, although a particular blanket assembly 14 has been disclosed, it should be appreciated that any blanket subject to deterioration from contact with dampening liquid can benefit from the invention. Also, while only a preferred embodiment of a manual ejector mechanism 70 has been shown, nonmanual and other types of ejector actuation which do not require rotary movement could also be used. Likewise, although a mounting member and mating slot has only been shown for the leading edge, since the leading edge is the one which suffers most from pressurized contact with the dampening liquid, inwardly turned mounting member similar to mounting members 30M and 34M could be used also at the lagging edge. Reference should therefore be made to the appended claims to determine the scope of the invention.

We claim:

1. A printing blanket cylinder, comprising:

a cylindrical body with a slot for receipt of a mounting member of a printing blanket assembly; and an ejector mechanism mounted to the cylindrical body for pushing the mounting member out of the slot during removal of the printing blanket assembly from around the cylindrical body, wherein said ejector mechanism includes a rotatable adjustment member located outside of the mounting slot and linked with an ejector blade for causing it to move within the mounting slot.

2. The printing blanket cylinder of claim 1 in which said ejector mechanism includes an elongate pusher blade mounted for translational movement within the mounting slot.

3. A method of dismounting a blanket assembly with a mounting member and a substantially cylindrical body from a blanket cylinder with a mounting slot comprising the steps of:

at least partly removing a mounting member from within the mounting slot at least in part by pushing the mounting member from within the slot;

removing the remainder of the blanket assembly from around the blanket cylinder after the mounting member has been at least partly removed from the mounting slot wherein said step of pushing includes the step of actuating an adjustment member outside of the slot which is linked with an ejector blade to cause the blade to move within the slot.

4. The method of claim 3 in which said step of removing is performed manually after the cylindrical body of the blanket has been in at least part lifted from the blanket cylinder by pushing the mounting member at least partly out of the slot.

5. The method claim 3 including the step of lowering the ejector blade to the bottom of the slot after the step of pushing to prepare the slot for receipt of another mounting member.

* * * * *